US009755304B2

(12) United States Patent
Liu et al.

(10) Patent No.: US 9,755,304 B2
(45) Date of Patent: Sep. 5, 2017

(54) GROUNDING STRUCTURE AND ROTARY WIRELESS NETWORK CARD

(71) Applicant: ZTE Corporation, Shenzhen, Guangdong (CN)

(72) Inventors: Yang Liu, Shenzhen (CN); Chaofan Shu, Shenzhen (CN)

(73) Assignee: ZTE Corporation, Shenzhen, Guangdong (CN)

( * ) Notice: Subject to any disclaimer, the term of this patent is extended or adjusted under 35 U.S.C. 154(b) by 0 days.

(21) Appl. No.: 14/901,836

(22) PCT Filed: Aug. 21, 2013

(86) PCT No.: PCT/CN2013/081939

§ 371 (c)(1),
(2) Date: Dec. 29, 2015

(87) PCT Pub. No.: WO2014/161260

PCT Pub. Date: Oct. 9, 2014

(65) Prior Publication Data

US 2016/0226138 A1 Aug. 4, 2016

(30) Foreign Application Priority Data

Jul. 1, 2013 (CN) ..... 2013 1 0272323

(51) Int. Cl.
*H01Q 1/48* (2006.01)
*H01Q 1/52* (2006.01)
(Continued)

(52) U.S. Cl.
CPC ..... *H01Q 1/48* (2013.01); *H01Q 1/2275* (2013.01); *H01Q 1/52* (2013.01); *H01Q 1/526* (2013.01); *H01R 35/04* (2013.01)

(58) Field of Classification Search
CPC ..... H01Q 1/48; H01Q 1/2275; H01Q 1/52
(Continued)

(56) References Cited

U.S. PATENT DOCUMENTS

2010/0161865 A1* 6/2010 Xie ..... H01R 12/722 710/300
2011/0234459 A1* 9/2011 Yabe ..... H01Q 1/243 343/702
2012/0176750 A1 7/2012 Xie
2014/0017918 A1 1/2014 Guo
2015/0072539 A1 3/2015 Xie

FOREIGN PATENT DOCUMENTS

CN 201323599 Y 10/2009
CN 201348880 Y 11/2009
(Continued)

OTHER PUBLICATIONS

Supplementary European Search Report in European application No. 13881089.0, mailed on Jun. 9, 2016.
(Continued)

*Primary Examiner* — Dameon E Levi
*Assistant Examiner* — Andrea Lindgren Baltzell
(74) *Attorney, Agent, or Firm* — Oppedahl Patent Law Firm LLC

(57) ABSTRACT

A grounding structure is described in an embodiment of the present disclosure, which is applied to a rotary wireless access terminal, the wireless access terminal at least includes that: a structural part, as well as a main board and metal rotating shaft, which are arranged in the structural part, of the wireless access terminal, the metal rotating shaft is connected with an external interface of the wireless access terminal, wherein the grounding structure includes a metal dome and an insulating film; and one end of the metal dome is connected with the metal rotating shaft, while the other end is coupled to ground on the main board through the insulating film. A rotary wireless network card based on the
(Continued)

above grounding structure is also described in an embodiment of the present disclosure. By the technical solutions of the embodiment of the present disclosure, an interference loop effect formed by a radio frequency current flowing through the main board may be effectively eliminated, the problem of poor low-frequency performance of a built-in antenna is effectively solved, and sensitivity of a low-frequency antenna is improved.

16 Claims, 1 Drawing Sheet

(51) Int. Cl.
*H01Q 1/22* (2006.01)
*H01R 35/04* (2006.01)

(58) Field of Classification Search
USPC ..... 343/846
See application file for complete search history.

(56) References Cited

FOREIGN PATENT DOCUMENTS

| | | | |
|---|---|---|---|
| CN | 101674674 | A | 3/2010 |
| CN | 102185233 | A | 9/2011 |
| CN | 102646907 | A | 8/2012 |
| WO | 2012097561 | A1 | 7/2012 |
| WO | 2012113203 | A1 | 8/2012 |

OTHER PUBLICATIONS

International Search Report in international application No. PCT/CN2013/081939, mailed on Apr. 3, 2014.

English Translation of the Written Opinion of the International Search Authority in international application No. PCT/CN2013/081939, mailed on Apr. 3, 2014.

* cited by examiner

GROUNDING STRUCTURE AND ROTARY WIRELESS NETWORK CARD

TECHNICAL FIELD

The present disclosure relates to a wireless terminal product technology, and in particular to a grounding structure and a rotary wireless network card.

BACKGROUND

Along with the development of a wireless broadband access technology and industry, services with a wireless network card which may help a user to access a wireless network anytime anywhere as an important part in the wireless network are more and more required. At present, a user not only makes requirements on performance of a wireless network card, but also has higher and higher requirements on its appearance.

At present, most of mainstream wireless network cards adopt Universal Serial Bus (USB) interfaces, and may be divided into direct plug-in wireless network cards and rotary wireless network cards. A direct plug-in wireless network card usually adopts a cap design to avoid a USB interface being exposed and easily damaged, but a cap is easily lost; and a rotating shaft is arranged in a rotary wireless network card, so that a USB interface is rotated into a body of the wireless network card when the wireless network card is not used, and the USB interface is unlikely to be damaged during storage. However, a metal dome fixed in a hot melting manner in a structural part of the rotary wireless network card is required to be kept at a certain upwarping angle to ensure good connection between the metal dome and a metal shielding casing of a main board, but the upwarping angle of the metal dome may not be ensured to be completely consistent in a manufacturing process, so that the rotary wireless network card is low in consistency, and low-frequency antenna performance of the rotary wireless network card is poorer than that of a direct plug-in wireless network card.

In order to solve the problem of poorer low-frequency antenna performance of a rotary wireless network card, manners of increasing a diameter of a grounding wire, additionally arranging a connecting wire between a main board and a USB interface, spraying a conductive paint onto a structural part of the wireless network card, adhering conductive foam, increasing a width of a metal dome, and the like are usually adopted in the related art, and however, each manner may greatly increase cost of the wireless network card.

SUMMARY

In view of this, a main purpose of an embodiment of the present disclosure is to provide a grounding structure and a rotary wireless network card, which may solve the problem of poor consistency of a rotary wireless network card and effectively improve sensitivity of a low-frequency antenna.

In order to achieve the purpose, the technical solutions of the present disclosure are implemented as follows.

An embodiment of the present disclosure provides a grounding structure, which is applied to a rotary wireless access terminal, wherein the wireless access terminal at least includes: a structural part, as well as a main board and metal rotating shaft, which are arranged in the structural part, of the wireless access terminal; the metal rotating shaft is connected with an external interface of the wireless access terminal; the grounding structure includes a metal dome and an insulating film; and one end of the metal dome is connected with the metal rotating shaft, while other end is coupled to ground on the main board through the insulating film.

Preferably, the other end being coupled to the ground on the main board through the insulating film may include:

a coupling connection region of the main board and the metal dome is subjected to copper exposure treatment on the main board; and the insulating film is arranged in a copper exposure region on the main board.

Preferably, the wireless access terminal may further include a circuit shielding casing arranged on the main board; and correspondingly, the other end being coupled to the ground on the main board through the insulating film may include:

the insulating film is arranged on the circuit shielding casing.

Preferably, an elastic pin may be arranged at other end of the metal dome, and the other end may contact with the insulating film through the elastic pin.

Preferably, the metal dome may be fixed on the structural part in a hot melting manner.

The embodiment of the present disclosure further provides a rotary wireless network card, which includes the abovementioned grounding structure.

Compared with the related art, the grounding structure and rotary wireless network card provided by the embodiment of the present disclosure have the advantages that the ground on the main board of the wireless access terminal may form a capacitive coupling effect with the metal dome to form a new loop by changing a grounding manner for the main board of the wireless access terminal, so that an interference loop effect formed by a radio frequency current flowing through the main board may be effectively eliminated, the problem of poor low-frequency performance of a built-in antenna is effectively solved, and sensitivity of a low-frequency antenna is improved.

DETAILED DESCRIPTION

A basic thought of an embodiment of the present disclosure is: a ground on a main board and a metal dome form a capacitive coupling effect to form a new loop in a coupling connection manner by changing a grounding manner for the main board, so that an interference loop effect formed by a radio frequency current flowing through the main board is effectively eliminated, and the problem of poor low-frequency performance of a built-in antenna is effectively solved.

The present disclosure is further described below with reference to the drawings and specific embodiments in detail.

Figure 1:
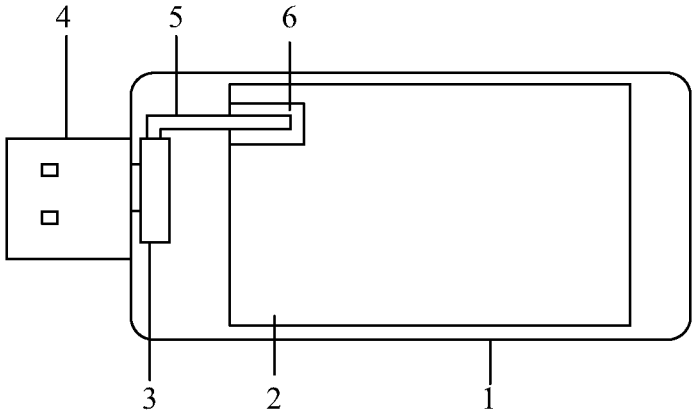
FIG. 1 is a schematic diagram of a grounding structure according to a first embodiment of the present disclosure.

FIG. 1 is a schematic diagram of a grounding structure according to a first embodiment of the present disclosure. As shown in FIG. 1, the embodiment is applied to a rotary wireless network card, wherein the wireless network card includes: a structural part 1, as well as a main board 2 and metal rotating shaft 3, which are arranged in the structural part 1, of the wireless network card; the metal rotating shaft 3 is connected with a USB interface 4 of the wireless network card; the grounding structure includes a metal dome 5 and an insulating film 6; and one end of the metal dome 5 is connected with the metal rotating shaft 3, while the other end is coupled to the ground on the main board 2 through the insulating film 6.

Preferably, a coupling connection region of the main board and the metal dome 5 is subjected to copper exposure treatment on the main board 2;

the insulating film 6 is arranged in the copper exposure region on the main board 2; and an elastic pin is arranged at the other end of the metal dome 5, and the other end contacts with the insulating film 6 through the elastic pin.

Specifically, one end of the metal dome 5 is connected with the metal rotating shaft 3, the metal rotating shaft is shaped into a nearly cylindrical tube or a nearly square tube, a small cylindrical column/small square column is embedded into a large cylindrical column/large square column, the small cylindrical column/small square column is fixed, the large cylindrical column/large square column rotates, and the metal dome 5 is connected with one end of the small cylindrical column/small square column; and the external interface 4 of the wireless network card is connected with the small cylindrical column/small square column through a metal wire.

The other end of the metal dome 5 is coupled to copper in a grounding layer on the main board 2 through the insulating film 6, and when there is a current generated, the grounding copper on the main board forms a capacitive coupling effect with the metal dome 5 to form a new loop, so that an interference loop effect formed by a radio frequency current flowing through the main board may be effectively eliminated, and the problem of poor low-frequency performance of a built-in antenna may be effectively solved.

Preferably, grounding layers are laid on both front and back surfaces of the main board 2, so that the coupling region of the metal dome 5 and the main board 2 may select the front surface or back surface of the main board 2 according to a design layout need of the main board 2.

Preferably, the metal dome 5 is arranged on the structural part 1 in a hot melting manner; and a coupling area of the metal dome 5 and the copper exposure region on the main board 2 may be regulated according to the design layout need of the main board 2, and the low-frequency performance of the built-in antenna is higher if the coupling area is greater.

Preferably, the insulating film 6 may be adhered to the copper exposure region on the main board 2 in an adhesion manner, an area and thickness of the insulating film 6 may be regulated according to the design layout need of the main board 2, but the area of the insulating film 6 is required to be greater than the coupling connection area of the metal dome 5 and the main board 2 to avoid direct contact between the metal dome 5 and the copper exposure region on the main board 2; and moreover, an adhesive for adhering the insulating film 6 may be an insulating adhesive.

Figure 2:
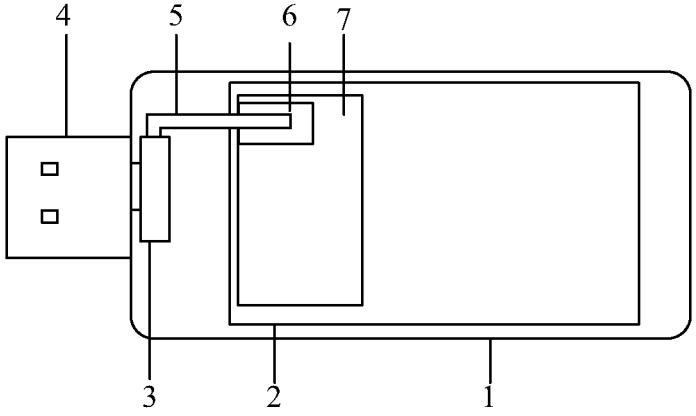
FIG. 2 is a schematic diagram of a grounding structure according to a second embodiment of the present disclosure.

FIG. 2 is a schematic diagram of a grounding structure according to a second embodiment of the present disclosure. As shown in FIG. 2, the embodiment is also applied to a rotary wireless network card, wherein the wireless network card includes: a structural part 1, as well as a main board 2 and metal rotating shaft 3, which are arranged in the structural part 1, of the wireless network card; the metal rotating shaft 3 is connected with a USB interface 4 of the wireless network card; the grounding structure includes a metal dome 5 and an insulating film 6; and one end of the metal dome 5 is connected with the metal rotating shaft 3, while the other end is coupled to the ground on the main board 2 through the insulating film 6.

Preferably, the wireless network card further includes a circuit shielding casing 7 arranged on the main board;

correspondingly, the other end being coupled to the ground on the main board through the insulating film includes: the insulating film 6 is arranged on the circuit shielding casing 7 of the main board 2; and an elastic pin is arranged at the other end of the metal dome 5, and the other end contacts with the insulating film 6 through the elastic pin.

Specifically, one end of the metal dome 5 is connected with the metal rotating shaft 3, the metal rotating shaft is shaped into a nearly cylindrical tube or a nearly square tube, a small cylindrical column/small square column is embedded into a large cylindrical column/large square column, the small cylindrical column/small square column is fixed, the large cylindrical column/large square column rotates, and the metal dome 5 is connected with one end of the small cylindrical column/small square column; and the external interface 4 of the wireless network card is connected with the small cylindrical column/small square column through a metal wire.

The other end of the metal dome 5 is coupled to the circuit shielding casing 7 of the main board 2 through the insulating film 6, and when there is a current generated, the metal shielding casing 7 and the metal dome 5 form a capacitive coupling effect to form a new loop, so that an interference loop effect formed by a radio frequency current flowing through the main board may be effectively eliminated, and the problem of poor low-frequency performance of a built-in antenna may be effectively solved.

Preferably, the circuit shielding casing of the main board includes a radio frequency circuit shielding casing on the main board.

Preferably, the metal dome 5 is arranged on the structural part 1 in a hot melting manner; and a coupling area of the metal dome 5 and the metal shielding casing 7 on the main board 2 may be regulated according to a design layout need of the main board 2, and the low-frequency performance of the built-in antenna is higher if the coupling area is greater.

Preferably, the insulating film 6 may be adhered to the metal shielding casing 7 of the main board 2 in an adhesion manner, an area and thickness of the insulating film 6 may be regulated according to the design layout need of the main board 2, but the area of the insulating film 6 is required to be greater than the coupling connection area of the metal dome 5 and the metal shielding casing 7 of the main board 2 to avoid direct contact between the metal dome 5 and the metal shielding casing 7 of the main board 2; and moreover, an adhesive for adhering the insulating film 6 may be an insulating adhesive.

The above are only preferred embodiments of the present disclosure and not intended to limit the scope of protection of the present disclosure. Any modifications, equivalent transformations, improvements and the like made within the spirit and scope of the present disclosure shall fall within the scope of protection of the present disclosure.

INDUSTRIAL PRACTICABILITY

According to an embodiment of the present disclosure, ground on a main board of a wireless access terminal and a metal dome form a capacitive coupling effect to form a new loop by changing a grounding manner for the main board of the wireless access terminal, so that an interference loop effect formed by a radio frequency current flowing through the main board may be effectively eliminated, the problem of poor low-frequency performance of a built-in antenna is effectively solved, and sensitivity of a low-frequency antenna is improved.

What is claimed is:

1. A grounding structure, applied to a rotary wireless access terminal, at least comprising: a structural part, as well as a main board and metal rotating shaft, which are arranged in the structural part, of the wireless access terminal; the metal rotating shaft is connected with an external interface of the wireless access terminal; the grounding structure comprises a metal dome and an insulating film; and one end of the metal dome is connected with the metal rotating shaft, while other end is coupled to ground on the main board through the insulating film such that the ground on the main board and the metal dome form a capacitive coupling effect in a coupling connection manner, to form a new loop.

2. The grounding structure according to claim 1, wherein the other end being coupled to the ground on the main board through the insulating film comprises:

a coupling connection region of the main board and the metal dome is subjected to copper exposure treatment on the main board; and the insulating film is arranged in a copper exposure region on the main board.

3. The grounding structure according to claim 1, wherein the wireless access terminal further comprises a circuit shielding casing arranged on the main board; and correspondingly, the other end being coupled to the ground on the main board through the insulating film comprises:

the insulating film is arranged on the circuit shielding casing.

4. The grounding structure according to claim 1, wherein an elastic pin is arranged at other end of the metal dome, and the other end contacts with the insulating film through the elastic pin.

5. The grounding structure according to claim 1, wherein the metal dome is fixed on the structural part in a hot melting manner.

6. A rotary wireless network card, comprising a grounding structure applied to the rotary wireless network card, wherein the rotary wireless network card at least comprises: a structural part, as well as a main board and metal rotating shaft, which are arranged in the structural part, of the rotary wireless network card; the metal rotating shaft is connected with an external interface of the rotary wireless network card; the grounding structure comprises a metal dome and an insulating film; and one end of the metal dome is connected with the metal rotating shaft, while other end is coupled to ground on the main board through the insulating film such that the ground on the main board and the metal dome form a capacitive coupling effect in a coupling connection manner, to form a new loop.

7. The rotary wireless network card according to claim 6, wherein the other end being coupled to the ground on the main board through the insulating film comprises:

a coupling connection region of the main board and the metal dome is subjected to copper exposure treatment on the main board; and the insulating film is arranged in a copper exposure region on the main board.

8. The rotary wireless network card according to claim 6, wherein the rotary wireless network card further comprises a circuit shielding casing arranged on the main board; and correspondingly, the other end being coupled to the ground on the main board through the insulating film comprises:

the insulating film is arranged on the circuit shielding casing.

9. The rotary wireless network card according to claim 6, wherein an elastic pin is arranged at other end of the metal dome, and the other end contacts with the insulating film through the elastic pin.

10. The rotary wireless network card according to claim 6, wherein the metal dome is fixed on the structural part in a hot melting manner.

11. The rotary wireless network card according to claim 6, wherein the metal rotating shaft is shaped into a nearly cylindrical tube or a nearly square tube, a small cylindrical column or small square column is embedded into a large cylindrical column or large square column, the small cylindrical column or small square column is fixed, the large cylindrical column or large square column rotates.

12. The rotary wireless network card according to claim 11, wherein the metal dome is connected with one end of the small cylindrical column or small square column.

13. The rotary wireless network card according to claim 11, wherein the external interface of the rotary wireless network card is connected with the small cylindrical column or small square column through a metal wire.

14. The rotary wireless network card according to claim 8, wherein the insulating film is adhered to the circuit shielding casing of the main board in an adhesion manner.

15. The rotary wireless network card according to claim 14, wherein an adhesive for adhering the insulating film is an insulating adhesive.

16. The rotary wireless network card according to claim 8, wherein an area of the insulating film is greater than a coupling connection area of the metal dome and the circuit shielding casing of the main board to avoid direct contact between the metal dome and the circuit shielding casing of the main board.

* * * * *